US008066061B2

(12) United States Patent
Farquharson et al.

(10) Patent No.: US 8,066,061 B2
(45) Date of Patent: Nov. 29, 2011

(54) METAL SEAL FOR WELLHEADS

(75) Inventors: Keith D. Farquharson, Edmonton (CA); Tianle Guo, Edmonton (CA); Heinrich Lang, The Woodlands, TX (US); Tony Lam, Edmonton (CA); Kevin Paul Schneider, Nisku (CA)

(73) Assignee: Stream-Flo Industries Ltd., Edmonton (CA)

( * ) Notice: Subject to any disclaimer, the term of this patent is extended or adjusted under 35 U.S.C. 154(b) by 247 days.

(21) Appl. No.: 12/430,521

(22) Filed: Apr. 27, 2009

(65) Prior Publication Data

US 2009/0266558 A1 Oct. 29, 2009

Related U.S. Application Data

(60) Provisional application No. 61/048,078, filed on Apr. 25, 2008.

(51) Int. Cl.
*E21B 33/04* (2006.01)

(52) U.S. Cl. ..... 166/75.11; 277/323

(58) Field of Classification Search ..... 166/378, 166/75.11, 377; 277/323; 285/123.12
See application file for complete search history.

(56) References Cited

U.S. PATENT DOCUMENTS

| | | | | |
|---|---|---|---|---|
| 4,470,609 | A | 9/1984 | Poe | |
| 4,471,965 | A | 9/1984 | Jennings et al. | |
| 5,039,140 | A * | 8/1991 | Szymczak | 285/334.2 |
| 5,135,266 | A | 8/1992 | Bridges et al. | |
| 5,149,148 | A | 9/1992 | Taeuber, Jr. et al. | |
| 5,667,014 | A * | 9/1997 | Slider et al. | 166/378 |
| 5,944,319 | A | 8/1999 | Kohlman | |
| 6,007,111 | A * | 12/1999 | Wafer | 285/334.2 |
| 6,237,968 | B1 | 5/2001 | Bohnes | |
| 6,561,521 | B2 | 5/2003 | Janoff et al. | |
| 6,722,426 | B2 * | 4/2004 | Sweeney et al. | 166/115 |
| 7,159,652 | B2 | 1/2007 | McGuire et al. | |

* cited by examiner

*Primary Examiner* — Kenneth L Thompson
(74) *Attorney, Agent, or Firm* — Greenlee Sullivan P.C.

(57) ABSTRACT

A reusable metal seal for a wellhead provides a metal-to-metal seal and includes upper and lower tapered sealing flanks which may be deflected by tapered wall surfaces on the wellhead engaging the taper sealing flanks, and the seal may have a plurality of annular relief grooves.

22 Claims, 2 Drawing Sheets

METAL SEAL FOR WELLHEADS

RELATED APPLICATION

This application claims the benefit, and priority benefit, of U.S. Provisional Patent Application Ser. No. 61/048,078, filed Apr. 25, 2008, and entitled METAL SEALS FOR WELLHEADS.

BACKGROUND OF THE INVENTION

1. Field of the Invention

The invention relates to a metal seal for use in wellheads for use in oilfield wells.

2. Description of the Related Art

Various types of metal seals have been used for many years in wellheads.

SUMMARY OF THE INVENTION

In accordance with the illustrative embodiments hereinafter described, the present metal seal may provide a metal-to-metal seal between a casing head and a tubing head, the casing head and tubing head each having a tapered wall surface adapted for engagement with the seal. The seal may include an annular seat member having an upper and a lower end and an inner wall surface and an outer wall surface, an upper tapered sealing flank disposed on the outer wall surface of the seal member disposed adjacent the upper end of the annular seal member, a lower tapered sealing flank disposed on the outer wall surface of the seal member disposed adjacent the lower end of the annular seal member. The upper and lower tapered sealing flanks may have a first diameter before engagement with the tapered wall surfaces of the casing head and the tubing head, and the upper and lower tapered sealing flanks may have a second diameter after engagement with the tapered wall surfaces of the casing head and the tubing head. The second diameter may be smaller than the first diameter. After the seal member is removed from engagement with the tapered wall surfaces of the tubing head and the casing head, the upper and lower tapered sealing flanks may have a third diameter, and the third diameter may be substantially the same as the first diameter.

BRIEF DESCRIPTION OF THE DRAWING

The present metal seal for a wellhead may be understood by reference to the following description taken in conjunction with the accompanying Drawing, in which.

While certain embodiments of the present metal seal will be described in connection with the preferred illustrative embodiment shown herein, it will be understood that it is not intended to limit the invention to that embodiment. On the contrary, it is intended to cover all alternatives, modifications; and equivalents, as may be included within the spirit and scope of the invention as defined by the appended claims.

DETAILED DESCRIPTION OF THE SPECIFIC EMBODIMENTS

Figure 1:
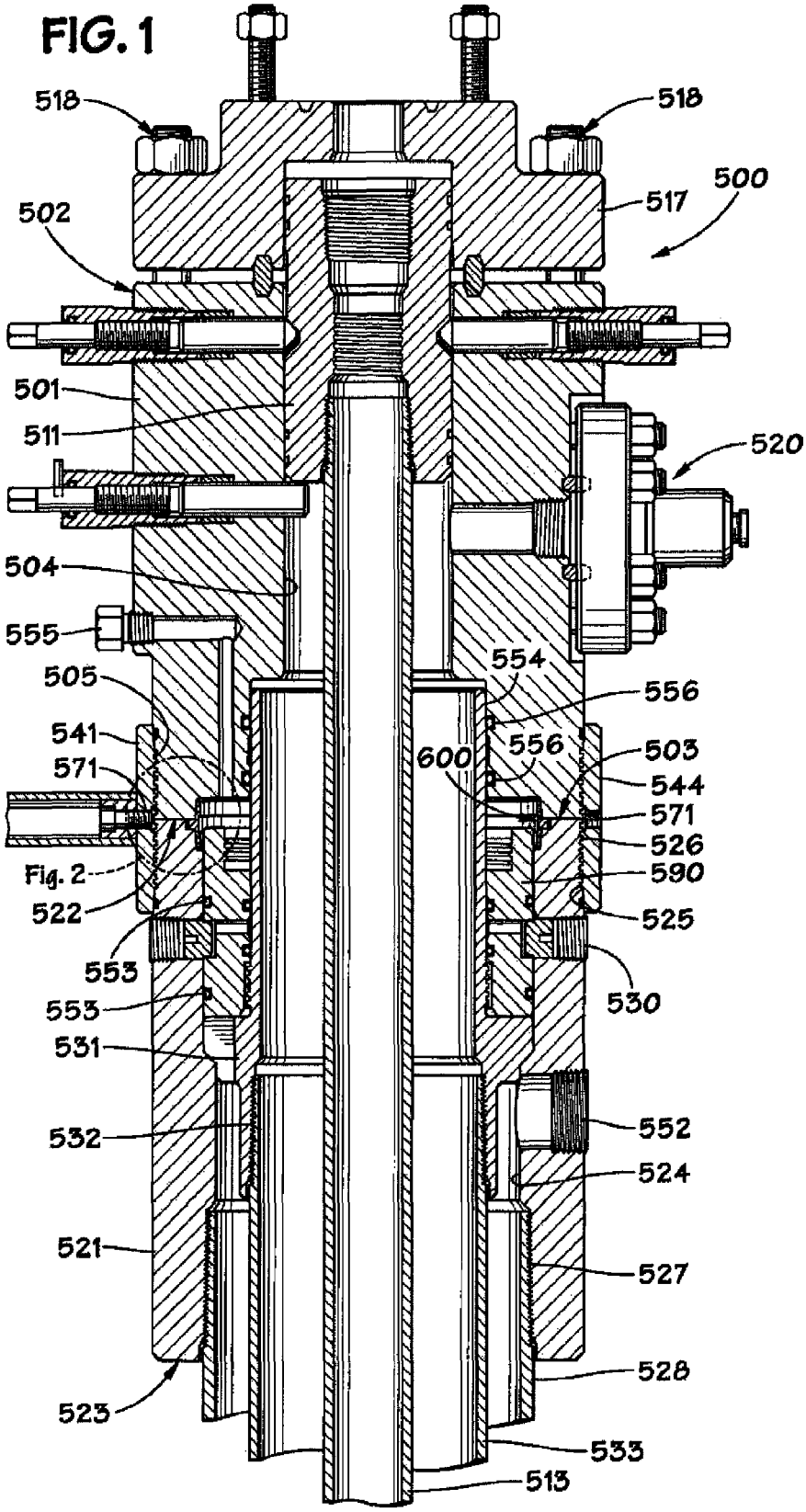
FIG. 1 is a partial cross-sectional view of an illustrative view of a wellhead provided with an illustrative embodiment of the present metal seal.
Figure 2:
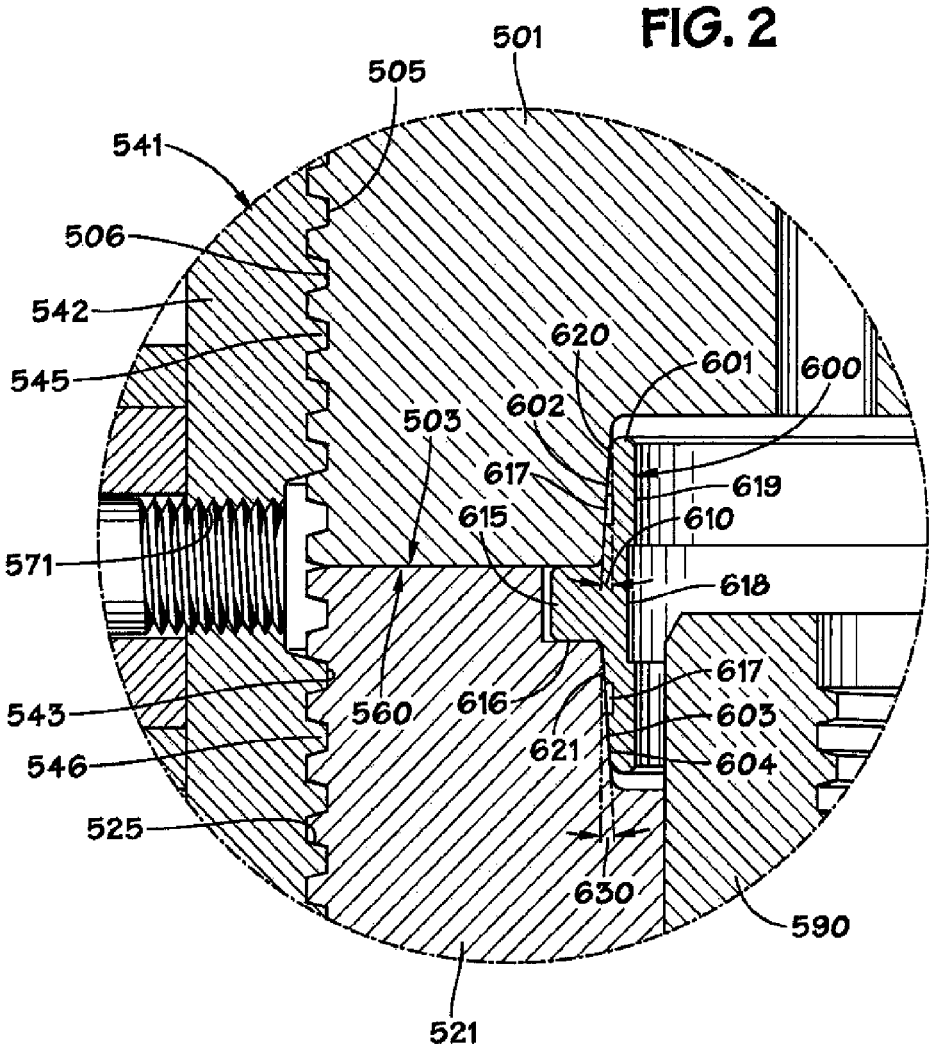
FIG. 2 is an exploded cross-sectional view of a portion of the wellhead of FIG. 1 within the dotted line circle denoted FIG. 2 in FIG. 1.

In FIGS. 1 and 2, one illustrative embodiment of a wellhead, or wellhead system, 500 with which the present metal seal may be used is illustrated. Wellhead system 500 is seen to generally include a tubing head 501, a tubing hanger 511, a casing head 521, a casing hanger 531, and a connector 541, which releasably connects the tubing head 501 to casing head 521.

Tubing head 501 has a generally annular-shaped cross-sectional configuration, and has an upper end 502, a lower end 503, and a bore 504 extending from the upper end 502 to the lower end 503 of the tubing head 501. A first set of threads 505 is disposed upon an outer surface 506 of tubing head 501, the first set of threads 505 being preferably disposed adjacent the lower end 503 of tubing head 501, as shown in FIGS. 1 and 2. As will be hereinafter described, the first set of threads 505 is preferably a left-hand set of threads.

Tubing hanger 511 may be of any design compatible with tubing head 501, and is disposed in the bore 504 of the tubing head 501. Tubing hanger may have a length of production tubing 513 suspended from it. Tubing head 501 may have a tubing adapter 517 disposed above the upper end 502 of tubing head 501, and the tubing adapter 517 may be secured to tubing head 501 as by a plurality of nuts and bolts 518. At least one, and preferably two, studded side outlets 520 may be provided and sealingly secured to tubing head 501, whereby conventional valves, such as gate valves (not shown) may be secured. Studded side outlet(s) 520 are typically in fluid communication with the bore 504 of tubing head 501.

With reference to FIGS. 1 and 2, casing head 521 is of a generally annular shaped cross-sectional configuration and has an upper end 522, a lower end 523, and a bore 524 extending from the upper end 522 to the lower end 523 of the casing head 521. Any suitable type of casing head 521 could be utilized, such as the illustrated fluted casing hanger 521, used in combination with a conventional pack off member 590. A second set of threads 525 are disposed on an outer surface 526 of the casing head 521, and preferably the second set of threads 525 are disposed adjacent the upper end 522 of the casing head 521. Preferably, the second set of threads 525 are a right-hand set of threads. Casing hanger 531 is disposed in the bore 524 of casing head 521. Casing hanger 531 is provided with a plurality of threads 532, which threadedly engage with the threads on the upper end of a length of production casing 533. Casing head 521 may also include a set of threads 527 which threadedly engage with a set of threads on the upper end of a length of an outer, or surface, casing 528. Additionally, casing head 521 may also include one or more seal test ports 530. Casing head 521 may also include, if desired, a threaded side outlet 552 and a plurality of conventional seals 553. The seal test ports 530 may be used to test the seal between seals 553 in a conventional manner.

Still with reference to FIGS. 1 and 2, the lower end 503 of tubing head 501 may be provided with an internal female recess, or bore, 554, which may receive the upper end of the casing hanger 531 in a sealed relationship as by the conventional seals 556. Tubing head 501 may also include a flange test port 555 which may be used in a conventional manner to test the sealed relationship between the lower end 503 of tubing head 501 with the upper end 522 of casing head 521. In this regard, as better seen in FIG. 2, a mating, or abutting, connection 560 is provided between the lower end 503 of tubing head 501 and the upper end 522 of casing head 521, wherein the lower end 503 of tubing head 501 abuts the upper end 522 of casing head 521 when the tubing head 501 and casing head 521 are in their sealed relationship as shown in FIG. 2.

Still with reference to FIGS. 1 and 2, connector 541 is shown to include a member 542 having an interior surface 543 which threadedly engages at least a portion of the first and second sets of threads 505, 525, on the tubing head 501 and the casing head 521. The interior surface 543 of connector member, or member, 542, has a generally circular cross-sectional configuration to threadedly mate with the threaded exterior outer wall surfaces of the tubing head 501 and casing head 521. Preferably connector member, or member, 542 is annular shaped, whereby its outer wall surface 544 also has a generally circular cross-sectional configuration, however, it should be noted that the outer cross-sectional configuration of the member 542 could be circular, square, hexagonal, etc. as desired.

The interior surface 543 of member 542 is provided with two sets of threads, 545, 546. One of the sets of threads is a set of left-hand threads, and the other set of threads is a set of right-hand threads. Preferably the upper set of threads 545 is a set of left-hand threads which engage the first set of threads 505 on the tubing head 501, which are also preferably a set of left-hand threads. Similarly, the lower set of threads 546 is a set of right-hand threads which engage the second set of threads 525 on the casing head 521, which are also preferably a set of right-hand threads. Thus, the set of threads 505 on the tubing head 501 may be threadedly received within connector 541 and threadedly engaged with the upper set of threads 545 of connector 541, and the second set of threads 525 of the casing head 521 may be received within connector 541 and threadedly engaged with the lower set of threads 546 of connector 541. It should be readily apparent, that if desired, the first set of threads 505 could be a set of right-hand threads, the upper set of threads 545 could be a set of right-hand threads, the second set of threads 525 of casing head 521 could be a left-hand set of threads, and the lower of threads 546 of connector 541 could also be a left-hand set of threads.

If the sets of threads 505, 545 are sets of let-hand threads, and the sets of threads 525 and 546 are right-hand sets of threads, upon the tubing head 501 and the casing head 521 being initially brought into threaded engagement with connector 541, upon rotation of connector 541 in a right-hand fashion, or in a clockwise direction when viewed from the top of wellhead system 500, the rotation of connector 541, or connector member 542, will cause relative movement of connector 541 with respect to both the tubing head 501 and the casing head 521; and the tubing head 501 and the casing head 521 will be drawn toward each other until they are in the sealed relationship illustrated in FIG. 2. Similarly, if the first set of threads 505 and the upper set of threads 545 are right-hand sets of threads and the second set of threads 525 and the lower set of threads 546 are each left-hand sets of threads, upon rotation of connector 541 in a left-hand fashion, or in a counterclockwise direction when viewed from the top of wellhead system 500, again the tubing head 501 and casing head 525 will be drawn together into the sealed relationship illustrated in FIG. 2. In either embodiment, rotation of connector 541 may be provided in any suitable manner, such as by handles (not shown) which may be threaded into threaded openings 571 in connector.

With reference to FIG. 2, a seal 600 may be disposed between tubing head 501 and casing head 521. Seal 600 is a tapered, pressure energized seal, in that pressure forces from within tubing head 501 and casing head 521 acting upon seal 600 will enhance the sealing effect of seal 600. Seal 600 is generally an annular shaped member, or seal member, 601, having upper and lower tapered sealing flanks, seal lips, or tapered seal surfaces 602, 603, disposed on the outer wall surface 604 of seal member 601. The angle 610 of the taper for sealing flanks 602, 603 is generally within the range of 5°-7°, and may be characterized as a relatively shallow taper. An outer annular rib, or ridge member, 615 may be formed, or disposed, on the outer wall surface 604 of seal member 601, as seen in FIG. 2. Preferably, the cross-sectional configuration of annular rib is rectangular; however, other cross-sectional configurations, such as square, or trapezoidal, could be utilized.

After seal 600 is installed in casing head 521, as connector 541 is rotated, as previously described, to draw tubing head 501 and casing head 521 together into the sealed relationship shown in FIG. 2, sealing flanks 602 and 603 engage tapered wall surfaces 620 and 621, formed on the lower end of tubing head 501 and the upper end of casing head 521, respectively. The angle 630 of the taper of tapered wall surfaces 620 and 621, may be the same as angle 610, but preferably is less, or shallower, than the angle 610, and is generally within the range of 3°-6°, so that an interference fit is provided between the sealing flanks 602, 603 and the tapered wall surfaces 620, 621. Thus, as tapered sealing flanks 602, 603 and tapered wall surfaces 620, 621 are drawn together with this interference fit, a metal-to-metal seal is provided between tubing head 501 and casing head 521. As the taper of tapered sealing flanks 602, 603 and tapered wall surfaces 620, 621 are relatively shallow, the makeup torque required to energize seal 600 is minimized. Seal 600 is reusable, as the force applied to seal 600 is less than the elastic limit of the material from which seal 600 is manufactured. Thus, upon a metal-to-metal seal being created by seal 600 between tubing head 501 and casing head 521, seal 600 is not permanently distorted by the movement of tubing head 501 and casing head 521, as previously described.

Generally, the seal member 601 at its upper and lower ends, defined by the tapered sealing flanks 602, 603, has a first, or undeflected, diameter before being installed in casing head 521. After casing head 521 and tubing head 501 are placed in their sealed relationship as previously described and as shown in FIG. 2, the tapered wall surfaces 620, 621 of the tubing head 501 and the casing head 521 act upon the upper and lower tapered sealing flanks 602, 603 to cause sealing flanks 602, 603 to be deflected inwardly, as the metal-to-metal seal is being made, whereby the seal member 601 at its upper and lower ends has a second, or deflected or distorted, diameter which is less than the first diameter. After the disconnection, or disassembly of tubing head 501 and casing head 521, the seal member, or its upper and lower tapered sealing flanks, springs or moves outwardly to a third diameter which is substantially the same as, if not the same, as the first undeflected, undistorted diameter, whereby seal 600 may be reused.

Still with reference to FIG. 2, the upper end 522 of casing 521 may be provided with an annular groove, or rabbit groove 616, which receives rib, or ridge member, 615. Each of the sealing flanks, or seal lips, 602, 603, may be provided with an annular relief groove 617. An annular relief groove 618 may be formed in the interior wall surface 619 of seal member 601. The cross-sectional configuration of the relief grooves 617 is preferably rectangular; however, other cross-sectional configurations could be utilized, such as square, semi-circular, or trapezoidal. Similarly, the cross-sectional configuration of the relief groove 618 is preferably rectangular; however, other cross-sectional configurations, such as those previously described could be utilized.

The relief grooves, or force relief grooves, 617 and 618, provide for controlled deflection of sealing flanks 602, 603, as they become engaged in the previously described interference fit with the tapered wall surfaces 620 and 621 on the lower end of tubing head 501 and the upper end of casing head 521. The relief grooves 617, 618, also assist in insuring that sealing flanks 602, 603 are not deflected upon make-up, beyond the elastic limit of the material forming seal member 601, so that sealing flanks 602, 603 are not permanently deflected, or distorted, upon make-up, but may spring back into substantially their original configuration upon disassembly of tubing head 501 and casing head 521, as by rotation of connector 541, as previously described.

Preferably, as shown in FIG. 2, pressure relief grooves 617 are disposed substantially intermediate the upper and lower ends of each sealing flank 602, 603; however, relief grooves 617 could be disposed upwardly or downwardly from their locations illustrated in FIG. 2. Similarly, relief groove 618 on the interior surface 619 of seal member 601 is preferably disposed intermediate the top and bottom of seal member 601, and opposite from annular rib, or ridge member, 615. It should be noted that the size of relief grooves 617, 618 may be varied. Additionally, more than one groove 618 could be provided, such as a plurality of smaller grooves disposed opposite ridge member 615. Further, additional relief grooves 617 could also be provided if desired. Additionally, if desired, relief grooves 617 and 618 may not be used, or alternatively, relief grooves 617 could be deleted and relief grooves 618 could be provided, or relief grooves 617 could be utilized without relief groove 618.

It should be noted that seal 600 may be formed of any suitable material having the requisite strength, flexibility, and sealing characteristics to function in the manner previously described. Suitable materials from which to make the foregoing described seals include, but are not limited to, stainless steel and Inconel®, which is a family of nickel-based superalloys made by Special Metals Corporation. It should be further noted that although the foregoing seals are illustrated for use in connection with wellhead 500, and to provide sealing between tubing heads and casing heads, the present seals could be utilized to effect and provide seals between other wellhead components, such as between casing heads and extension spools, and between landing and installation tools, as well as other wellhead components. In this regard, the use of the terms "tubing head" and "casing head" in the appended claims is intended to encompass these other types of wellhead components. Coatings of different types may be applied to the seal 600 for corrosion protection All of the previously described components may be manufactured of any suitable materials having the requisite strength characteristics to function in the manner described for the use of such components. Any type of thread profile may be utilized for the previously described sets of threads provided the thread profile permits the sets of threads to be engaged and operate in the manner previously described.

Specific embodiments of the present seal have been described and illustrated. It will be understood to those skilled in the art that changes and modifications may be made without departing from the spirit and scope of the inventions defined by the appended claims.

We claim:

1. A seal for a wellhead for providing a metal-to-metal seal between a casing head and a tubing head, the casing head and tubing head each having a tapered wall surface adapted for engagement with the seal, comprising:

an annular seal member having an upper and a lower end and an inner wall surface and an outer wall surface;

an upper tapered sealing flank disposed on the outer wall surface of the seal member and adjacent the upper end of the annular seal member;

a lower tapered sealing flank disposed on the outer wall surface of the seal member and adjacent the lower end of the annular seal member;

the upper and lower tapered sealing flanks having a first diameter before engagement with the tapered wall surfaces of the casing head and the tubing head;

the upper and lower tapered sealing flanks having a second diameter after engagement with the tapered wall surfaces of the casing head and the tubing head, with the second diameter being smaller than the first diameter;

after the seal member is removed from engagement with the tapered wall surfaces of the tubing head and the casing head, the upper and lower tapered sealing flanks have a third diameter, the third diameter being substantially the same as the first diameter; and at least one annular relief groove disposed on the upper tapered sealing flank, and at least one annular relief groove disposed on the lower tapered sealing flank.

2. The seal of claim 1, including at least one annular relief groove disposed on the inner wall surface of the seal member.

3. The seal of claim 1, wherein the annular relief grooves have a generally rectangular cross-sectional configuration.

4. The seal of claim 1, wherein the upper and lower tapered sealing flanks each have a taper angle, and the tapered wall surfaces of the tubing head and the casing head each have a taper angle, and the taper angle of the upper and lower tapered sealing flanks is less than the taper angle of the tapered wall surfaces of the tubing head and the casing head.

5. The seal of claim 1, wherein the presence of a pressure force within the seal member acts upon the inner wall surface of the seal member and acts upon the upper and lower tapered sealing flanks to urge them toward the tapered wall surfaces of the tubing head and the casing head.

6. The seal of claim 1 including an annular rib disposed on the outer wall surface of the annular seal member.

7. The seal of claim 6, wherein the annular rib has a generally rectangular cross-sectional configuration.

8. A seal for a wellhead for providing a metal-to-metal seal between a casing head and a tubing head, the casing head and tubing head each having a tapered wall surface adapted for engagement with the seal, comprising:

an annular seal member having an upper and a lower end and an inner wall surface and an outer wall surface;

an upper tapered sealing flank disposed on the outer wall surface of the seal member and adjacent the upper end of the annular seal member;

a lower tapered sealing flank disposed on the outer wall surface of the seal member and adjacent the lower end of the annular seal member;

the upper and lower tapered sealing flanks having a first diameter before engagement with the tapered wall surfaces of the casing head and the tubing head;

the upper and lower tapered sealing flanks having a second diameter after engagement with the tapered wall surfaces of the casing head and the tubing head, with the second diameter being smaller than the first diameter;

after the seal member is removed from engagement with the tapered wall surfaces of the tubing head and the casing head, the upper and lower tapered sealing flanks have a third diameter, the third diameter being substantially the same as the first diameter; and at least one annular relief groove disposed on the inner wall surface of the seal member.

9. The seal of claim 8, including at least one annular relief groove disposed on the upper tapered sealing flank, and at least one annular relief groove disposed on the lower tapered sealing flank.

10. The seal of claim 9, wherein the upper and lower tapered sealing flanks each have a taper angle, and the tapered wall surfaces of the tubing head and the casing head each have a taper angle, and the taper angle of the upper and lower tapered sealing flanks is less than the taper angle of the tapered wall surfaces of the tubing head and the casing head.

11. The seal of claim 9, wherein the presence of a pressure force within the seal member acts upon the inner wall surface of the seal member and acts upon the upper and lower tapered sealing flanks to urge them toward the tapered wall surfaces of the tubing head and the casing head.

12. The seal of claim 8, wherein the annular relief groove has a generally rectangular cross-sectional configuration.

13. A method for providing in a wellhead a metal-to-metal seal between a casing head and a tubing head, the casing head and tubing head each having a tapered wall surface for engagement with the seal, comprising:

installing a seal having an annular seal member having, an upper and a lower end and an inner wall surface and an outer wall surface, an upper tapered sealing flank disposed on the outer wall surface of the seal member and adjacent the upper end of the annular seal member, a lower tapered sealing flank disposed on the outer wall surface of the seal member and adjacent the lower end of the annular seal member;

providing relative movement between the casing head and the tubing head to cause the tapered wall surfaces of the casing head and tubing head to engage the upper and lower tapered sealing flanks of the seal, and the upper and lower tapered sealing flanks have a first diameter before engagement with the tapered wall surfaces of the casing head and the tubing head;

the upper and lower tapered sealing flanks to have a second diameter after engagement with the tapered wall surfaces of the casing head and the tubing head, with the second diameter being smaller than the first diameter; and disposing at least one annular relief groove on the upper tapered sealing flank, and disposing at least one annular relief groove on the lower tapered sealing flank.

14. The method of claim 13, including providing relative movement between the casing head and the tubing head to disconnect the casing head and the tubing head and removing the seal member from engagement with the tapered wall surfaces of the tubing head and the casing head, with the upper and lower tapered sealing flanks having a third diameter, the third diameter being substantially the same as the first diameter.

15. The method of claim 13, including disposing at least one annular relief groove on the inner wall surface of the seal member.

16. The method of claim 13, including utilizing annular relief grooves with a generally rectangular cross-sectional configuration.

17. The method of claim 13, including utilizing upper and lower tapered sealing flanks each having a taper angle, and utilizing tapered wall surfaces of the tubing head and the casing head having a taper angle, and having the taper angle of the upper and lower tapered sealing flanks being less than the taper angle of the tapered wall surfaces of the tubing head and the casing head.

18. The method of claim 13, including utilizing a seal member having an annular rib disposed on the outer wall surface of the annular seal member.

19. A method for providing in a wellhead a metal-to-metal seal between a casing head and a tubing head, the casing head and tubing head each having a tapered wall surface for engagement with the seal, comprising:

installing a seal having an annular seal member having, an upper and a lower end and an inner wall surface and an outer wall surface, an upper tapered sealing flank disposed on the outer wall surface of the seal member and adjacent the upper end of the annular seal member, a lower tapered sealing flank disposed on the outer wall surface of the seal member and adjacent the lower end of the annular seal member;

providing relative movement between the casing head and the tubing head to cause the tapered wall surfaces of the casing head and tubing head to engage the upper and lower tapered sealing flanks of the seal, and the upper and lower tapered sealing flanks have a first diameter before engagement with the tapered wall surfaces of the casing head and the tubing head;

the upper and lower tapered sealing flanks to have a second diameter after engagement with the tapered wall surfaces of the casing head and the tubing head, with the second diameter being smaller than the first diameter; and disposing at least one annular relief groove on the inner wall surface of the seal member.

20. The method of claim 19, including disposing at least one annular relief groove on the upper tapered sealing flank, and disposing at least one annular relief groove on the lower tapered sealing flank.

21. The method of claim 19, including utilizing an annular relief groove with a generally rectangular cross-sectional configuration.

22. The method of claim 19, including utilizing an annular rib with a generally rectangular cross-sectional configuration.

* * * * *